US008607686B2

(12) United States Patent
McKee et al.

(10) Patent No.: US 8,607,686 B2
(45) Date of Patent: Dec. 17, 2013

(54) CONTROLLED VEHICLE TURRET APPARATUS AND METHOD

(75) Inventors: Michael A. McKee, Aurora, IL (US); John E. Hayden, Aurora, IL (US)

(73) Assignee: Control Solutions LLC, Aurora, IL (US)

( * ) Notice: Subject to any disclaimer, the term of this patent is extended or adjusted under 35 U.S.C. 154(b) by 209 days.

(21) Appl. No.: 13/187,992

(22) Filed: Jul. 21, 2011

(65) Prior Publication Data

US 2012/0186440 A1 Jul. 26, 2012

Related U.S. Application Data

(60) Provisional application No. 61/435,053, filed on Jan. 21, 2011.

(51) Int. Cl.
*F41G 5/14* (2006.01)

(52) U.S. Cl.
USPC ..... 89/41.02; 89/41.01

(58) Field of Classification Search
USPC ..... 89/37.12, 37.13, 37.14, 37.21, 41.02; 114/5, 6, 7, 8
See application file for complete search history.

(56) References Cited

U.S. PATENT DOCUMENTS

| | | | | | |
|---|---|---|---|---|---|
| 2,410,723 | A | * | 11/1946 | Edwards et al. | 318/55 |
| 2,448,450 | A | * | 8/1948 | Maxson et al. | 89/41.18 |
| 2,968,997 | A | * | 1/1961 | Newton, Jr. et al. | 89/41.02 |
| 3,019,711 | A | * | 2/1962 | Bailey et al. | 89/41.02 |
| 4,361,071 | A | * | 11/1982 | Carlson et al. | 89/1.815 |
| 4,573,397 | A | * | 3/1986 | LeBlanc et al. | 89/41.12 |
| 5,123,327 | A | * | 6/1992 | Alston et al. | 89/1.813 |
| 5,210,371 | A | * | 5/1993 | Schneider et al. | 89/41.12 |
| 5,263,396 | A | * | 11/1993 | Ladan et al. | 89/1.11 |
| 5,347,910 | A | * | 9/1994 | Avila et al. | 89/41.22 |
| 5,353,680 | A | * | 10/1994 | Tiomkin et al. | 89/37.03 |
| 5,625,159 | A | | 4/1997 | Malolepsy et al. | |
| 5,880,395 | A | | 3/1999 | Krumm et al. | |
| 6,101,917 | A | | 8/2000 | Klatte et al. | |
| 6,701,821 | B2 | | 3/2004 | Lundqvist et al. | |
| 7,021,189 | B2 | | 4/2006 | Patry et al. | |
| 7,030,579 | B1 | * | 4/2006 | Schmitz et al. | 318/139 |
| 2008/0221754 | A1 | * | 9/2008 | Rowe et al. | 701/36 |

* cited by examiner

*Primary Examiner* — Bret Hayes
(74) *Attorney, Agent, or Firm* — McCracken & Frank LLC

(57) ABSTRACT

An apparatus for controlling rotational movement of a turret of a vehicle is provided. The apparatus includes a controller that generates a control signal for controlled operation of the turret in a controlled mode of operation. In response to a determination that a manual mode of operation has been initiated, the controller disables controlled operation of the turret of the vehicle.

26 Claims, 10 Drawing Sheets

CONTROLLED VEHICLE TURRET APPARATUS AND METHOD

CROSS-REFERENCE TO RELATED APPLICATION

The present application claims the priority benefit of U.S. Provisional Patent Application Ser. No. 61/435,053 filed Jan. 21, 2011 and entitled "Controlled Vehicle Turret Apparatus and Method," the disclosure of which is incorporated herein by reference.

FIELD OF THE INVENTION

This invention relates to vehicle turret systems and, in particular, to controllers for vehicle turrets.

BACKGROUND

Armored vehicles may include a rotatable turret and a weapon mounted to the turret for use in military operations. To assist the turret operator in rotating the turret, a controlled drive system may be installed in the armored vehicle. The drive system may include a motor that drives rotation of the turret and a controller that provides instructions to the motor. For example, the controller may instruct the motor to rotate the turret clockwise or counterclockwise depending on input from the turret operator. Input may be provided by an external input device coupled to the controller such as, for example, a joystick or other hand-actuatable input device.

In some circumstances, manual operation of the turret may be preferred over controlled operation of the turret. During manual operation, a hand-powered crank may be attached to the motor allowing the turret operator to spin the motor by turning the crank and thus rotating the turret. However, the crank can pose a danger to the turret operator when the crank is attached to the motor. Since the crank is attached to the motor itself, the crank will spin as the motor spins. Consequently, if the crank is attached to the motor while the motor is spinning during controlled turret rotation, the attached crank will also spin as the motor rotates the turret. Due to the high forces involved in rotating the turret, the crank may spin at a high velocity thus exposing the turret operator to potential risk of injury.

Therefore, a need exists for a controller of a vehicle turret that provides automated control checks during turret operation.

SUMMARY

An apparatus for controlling rotational movement of a turret of a vehicle is provided. The apparatus includes a controller that generates a control signal for controlled operation of the turret in a controlled mode of operation. In response to a determination that a manual mode of operation has been initiated, the controller disables controlled operation of the turret of the vehicle.

A method of controlling rotational movement of a turret of a vehicle is also provided. A controller automatically determines that operation of the turret of the vehicle is in a controlled mode of operation. The controller also automatically determines that a manual mode of operation of the turret has been initiated. In response to a determination that operation of the turret is in a controlled mode of operation, the controller generates a control signal for controlled operation of the turret. In response to a determination that a manual mode of operation has been initiated, the controller disables controlled operation of the turret of the vehicle.

DETAILED DESCRIPTION

Figure 1:
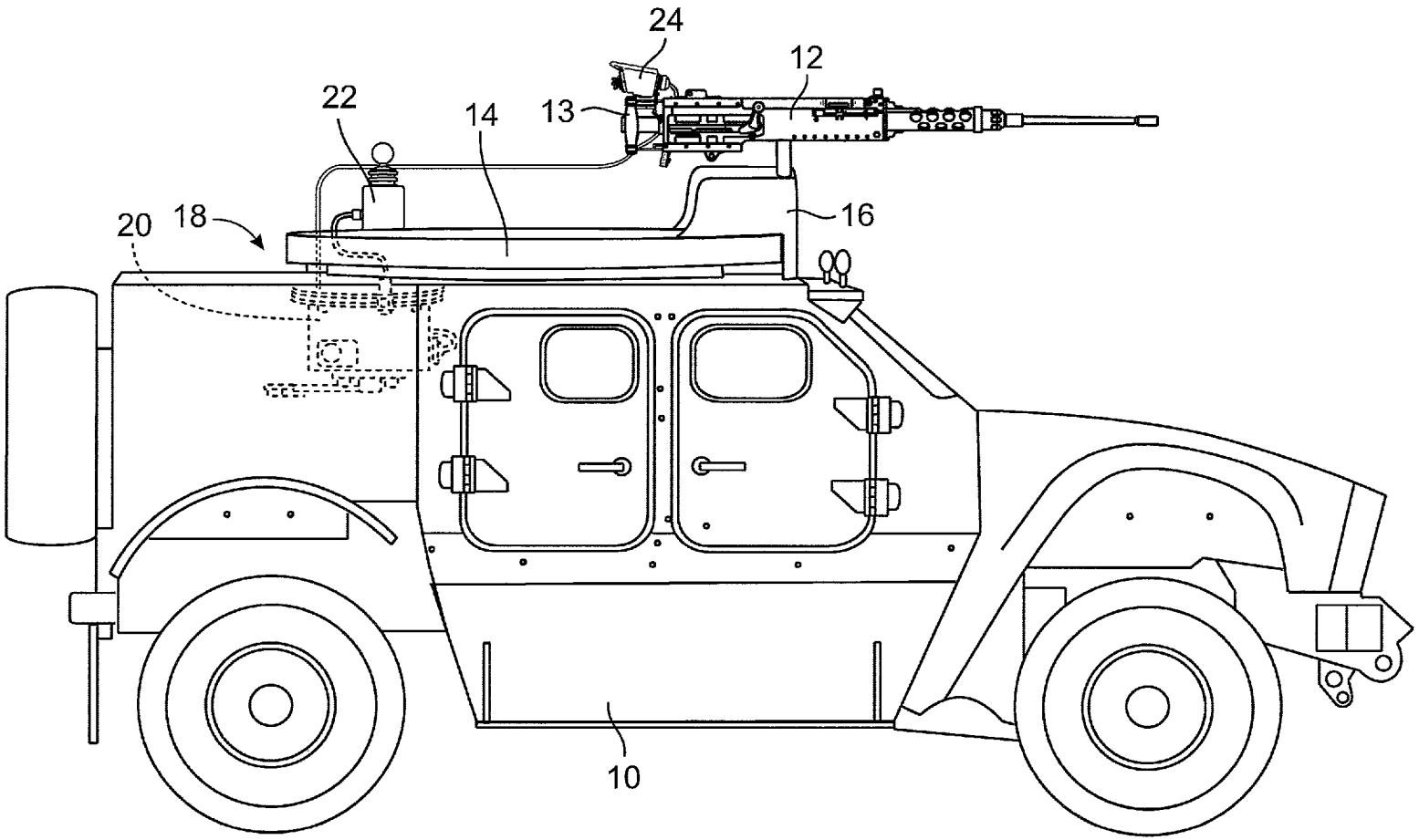
FIG. 1 is a right side view of an armored vehicle having a rotatable turret and a turret controller with a first input device and a second input device coupled to the controller.

A controlled vehicle apparatus and method are described. Referring to FIG. 1, a right profile view of an armored vehicle 10 having a firing device 12 mounted to a rotatable turret 14 is shown. The turret 14 may fully rotate 360° in a clockwise or counterclockwise direction. The turret 14 may include, among other components, shielding 16 to protect an operator during operation of firing device 12. In the example shown, the firing device 12 is a .50-caliber heavy machine gun (United States military designation Browning Machine Gun, Cal .50, M2, HB, Flexible) with a butterfly-style trigger 13. Other firing devices may selectively be employed.

Figure 2:
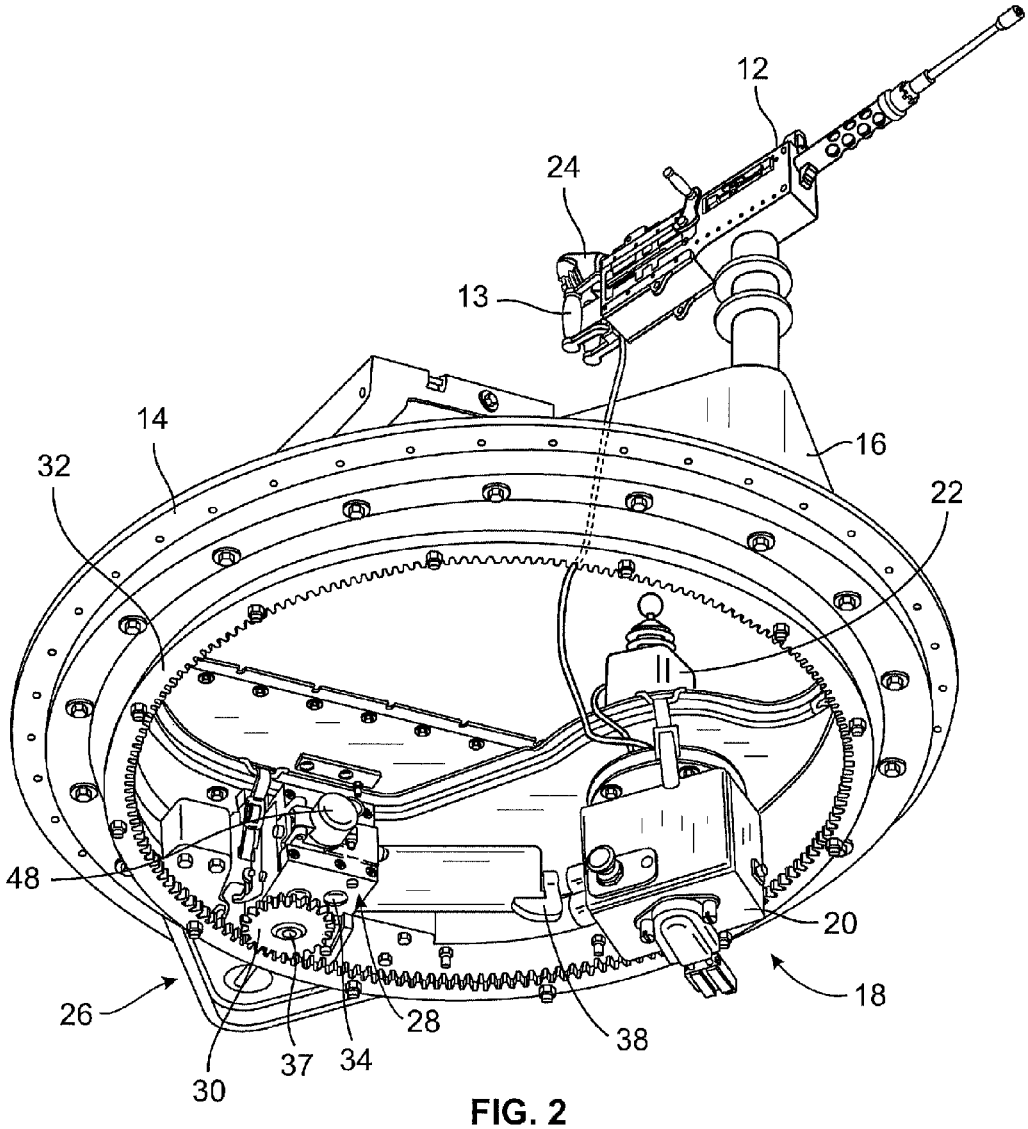
FIG. 2 is a bottom right perspective view of a turret and a controlled vehicle turret apparatus for an armored vehicle.

As shown in FIG. 1, the vehicle 10 includes a controlled vehicle turret apparatus 18 for controlling the rotational movement of the turret 14. The controlled vehicle turret apparatus 18, in the example shown, includes a controller 20, one or more input devices 22, 24, and a turret drive system 26 (FIG. 2). The controller 20 controls rotation of the turret 14 in response to operator input received from the input devices 22, 24. As explained further below, the controller 20 of the controlled vehicle turret apparatus 18 transmits control signals to the turret drive system 26, which drives rotation of the turret 14.

The controller 20 may be situated beneath the rotatable turret 14. In the example shown, two input devices 22, 24 are in communication with the controller 20—coupled to the controller in this example. The input devices 22, 24 enable an operator to rotate the turret 14 in a clockwise (CW) or counterclockwise (CCW) direction. The first input device 22 is a hand-operated joystick shown mounted to the top of the turret 14. The joystick 22 may have a magnetic base for releasable securement to the turret 14 or vehicle 10. Thus, an operator may position and reposition the joystick 22 on the turret 14 or, alternatively, on or within the armored vehicle 10 as desired. The second input device 24 may be adapted to be releasably secured to the firing device 10. In the example shown, the second input device 24 is attached to the butterfly-style trigger 13 of the firing device 10. The second input device 24 is a thumb-controlled input device ("thumbstick") that allows an operator to control rotation of the turret 14 without removing his hands from the trigger 13 of the firing device 10.

The computer-based controller 20 for the vehicle turret, in this example, may include various hardware components used to receive input from the input devices 22, 24 and used to monitor and transmit control signals to the turret drive system 26. The controller 20, in this example, may include firmware, a processor, and a memory. The firmware may be a combination of hardware, data, and computer instructions that reside as read-only software at the controller 20. The processor of the controller 20 may be implemented as one or more microprocessors capable of executing instructions or code. The memory of the controller 20 may be any form of data storage mechanism or any combination of such forms, such as a random access memory (RAM), a flash memory, an electrically erasable programmable read-only memory (EEPROM), a magnetic media, or an optical disk.

The input devices 22, 24 may send input signals to the controller 20 in response to actuation by a turret operator. For example, a turret operator may deflect the joystick 22 or thumbstick 24 to the left and to the right to rotate the turret 14 in a CW or CCW direction. In response to the leftward or rightward deflection, the input devices 22, 24 may send an input signal to the controller 20 based on the position of the input devices. For example, the input signal may be a variable analog voltage signal that corresponds to the direction and magnitude of actuation of the input devices 22, 24. Other types of input devices and input signals may be selectively employed.

Referring now to FIG. 2, a bottom right perspective view of the vehicle turret 14 and the controlled vehicle turret apparatus 18 is shown. As mentioned above, the controlled vehicle turret apparatus 18 includes a controller 20 that may be physically positioned near the underside of the turret 14. The controller 20 may also be coupled to a turret drive system 26 that drives rotation of the turret 14. The turret drive system 26, in the example shown, includes a drive unit 28 for driving the rotation of the turret 14, a drive gear 30 coupled to the drive unit, and a ring gear 32 mounted to the turret.

The drive unit 28 is a device that provides movement used to drive rotation of the turret. The drive unit 28, in the example shown, includes a housing 34, a motor 36, a drive shaft 37, an engagement lever 38, a brake system 40, and a safety switch 42. The drive gear 30 of the turret drive system 26 meshes with the drive shaft 37 of the motor 36 and the ring gear 32 of the turret drive system 26. Accordingly, as the motor 36 of the drive unit 28 spins, the drive gear 30 rotationally spins by the drive shaft 37 of motor 36. As the drive gear 30 spins, the drive gear transmits the torque to the ring gear 32, which causes the turret 14 to rotate in a CW or CCW direction. The motor 36 of the drive unit 28 may provide powered movement in response to control signals received from the controller 20. Alternative arrangements and designs for the drive unit may be selectively employed.

The motor 36 of the drive unit 28 may alternatively drive the turret 14 in response to a manual operation of the motor in contrast to a controlled operation of the motor by the controller 20. The manual spinning of the motor 36 to provide for rotation of the turret 14 as opposed to controlled spinning of the motor by the controller 20 is referred to in this application as a manual mode of operation or a manual drive mode. The drive unit 28, in this example, includes a spindle 44 (FIG. 3A) a turret operator may attach a hand-powered crank 46 (FIG. 3C) to. Rotating the crank 46 rotates the spindle 44, which spins the motor 36 in turn. As the motor 36 spins, the motor rotates the drive gear 30, engages the ring gear and rotates the turret 14. Manual operation of the turret 14 using the hand-powered crank 46 may be desirable during a manual override mode or any other scenario in which controlled operation of the turret via the controller is not desired or unavailable.

The drive unit 28 of the turret drive system 26, in this example, also includes fail-safe elements 38, 48 that, when positioned in certain ways, may indicate a manual drive mode has been initiated. The controller 20 monitors the status of the fail-safe elements 38, 48 to determine if a manual drive mode has been initiated. If the controller 20 determines that a manual drive mode has been initiated, the controller may disable controlled operation of the turret 14 of the vehicle 10 by ignoring input signals received at the controller from the input devices 22, 44. In the manual mode of operation, the controller 20 does not generate control signals corresponding to input signals received from the input devices 22, 24 and controlled operation of the turret 14 does not occur.

As shown by way of example in FIG. 2, the fail-safe elements include an engagement lever 38 and a spindle cap 48. As explained further below, disengaging the engagement lever 38 or opening the spindle cap 48 may indicate that a manual drive mode has been initiated, in this example. It will be understood that additional or alternative fail-safe elements may be selectively employed to indicate when a manual drive mode has been initiated. For example, a turret operator may also initiate a manual mode of operation by removing the hand-crank 46 from its storage compartment. In this example, removing the hand-crank from its storage compartment may open a switch, which may indicate the manual mode of operation has been initiated.

Additionally, the drive unit 28, in this example, includes a brake system 40 (FIGS. 4A-E) that is adapted to engage the motor 36 and prevent the motor from spinning. The engagement lever 38, spindle cap 48, and brake system 40 will be discussed below in further detail. The position of the engagement lever 38 and the spindle cap 48 may indicate whether a manual mode of operation has been initiated. A manual mode of operation may be initiated when a turret operator opens the spindle cap 48 or disengages the engagement lever 38. As mentioned above, removing the hand-crank 46 may also indicate initiation of the manual mode of operation. Upon initiation of the manual mode of operation, a brake system 40 may prevent the motor 36 from spinning freely to prevent undesired turret rotation. With the motor 36 secured by the brake system 40 and controlled operation of the turret disabled, an operator may safely attach the hand-powered crank 46 to the spindle 44 to rotate the turret 14 manually.

Figure 3A:
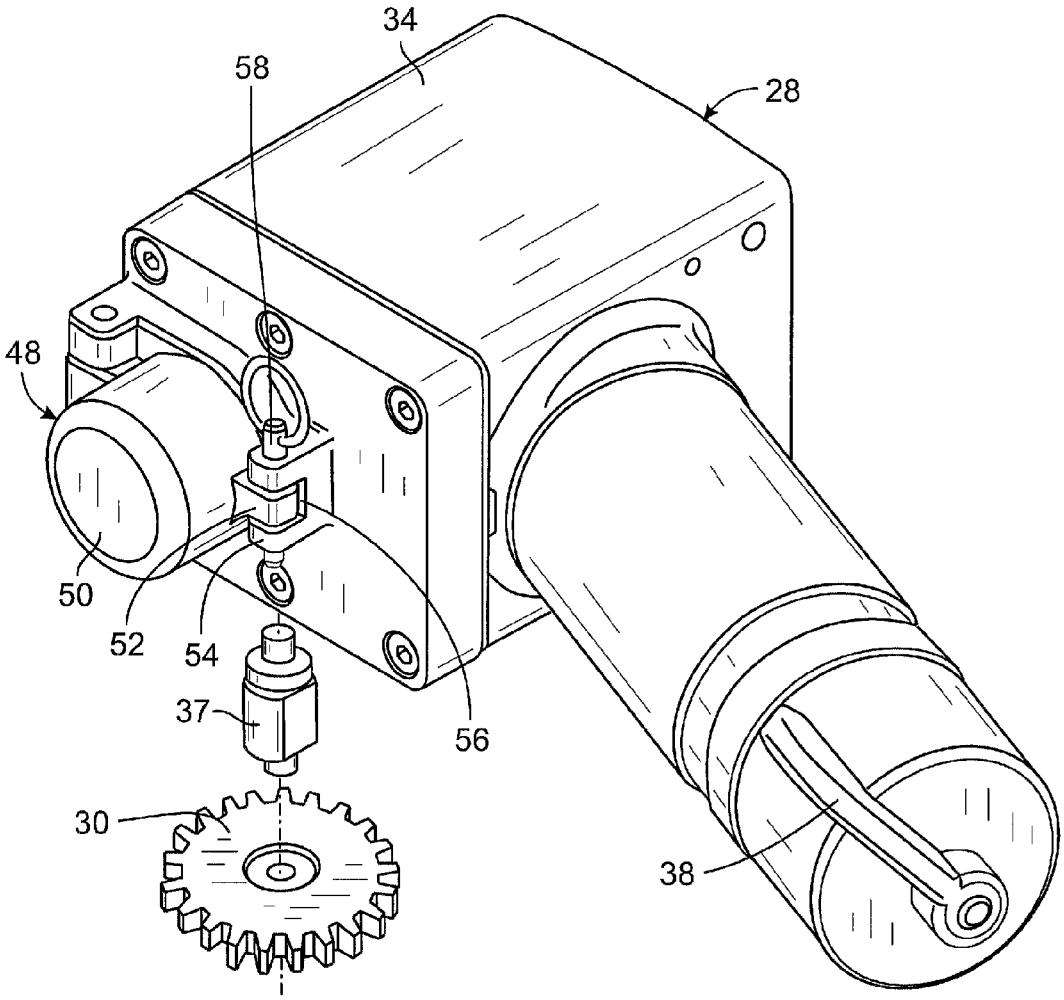
FIG. 3A illustrates an example drive unit for a controlled vehicle turret apparatus in a closed configuration.
Figure 3B:
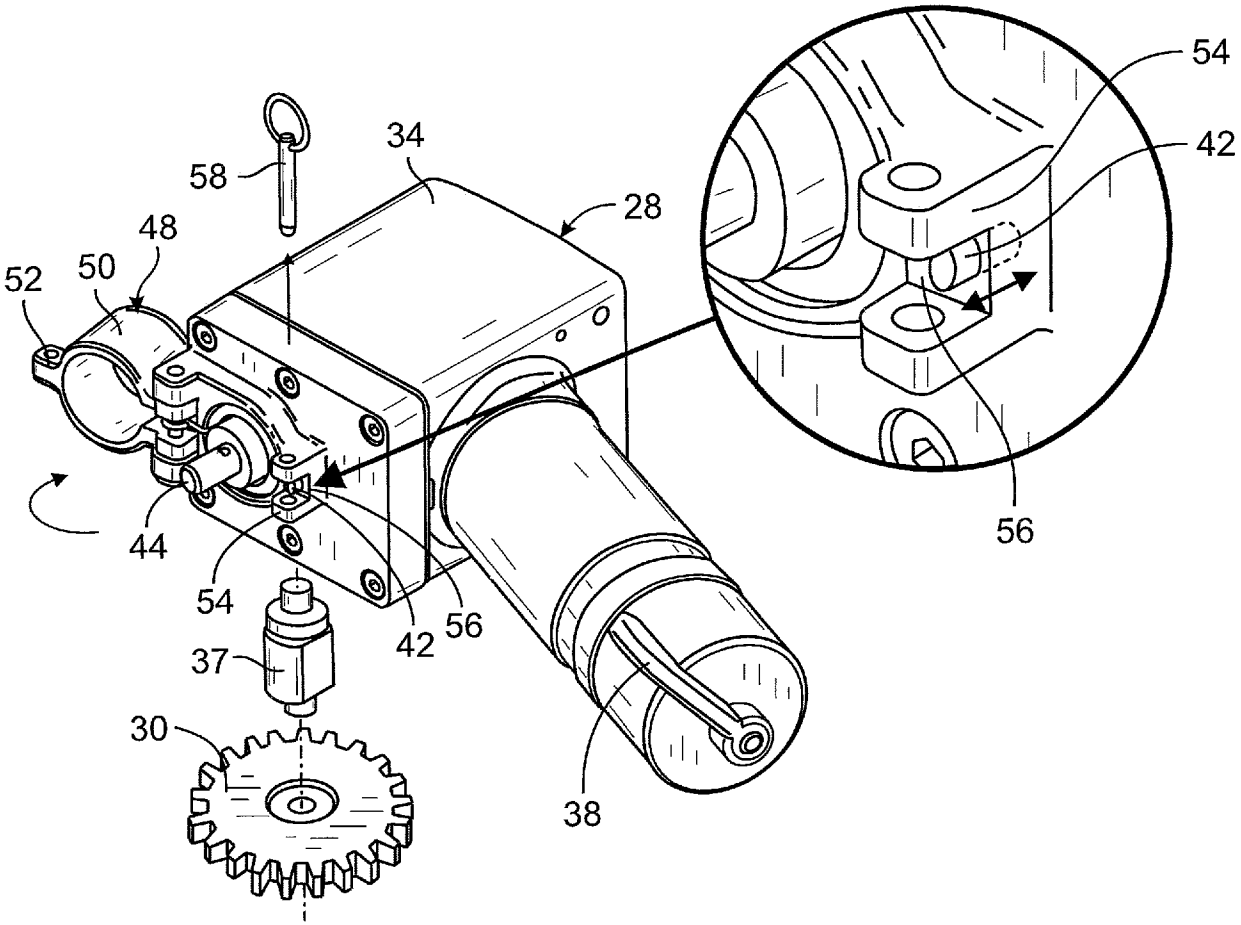
FIG. 3B illustrates the example drive unit of FIG. 3A in an open configuration.
Figure 3C:
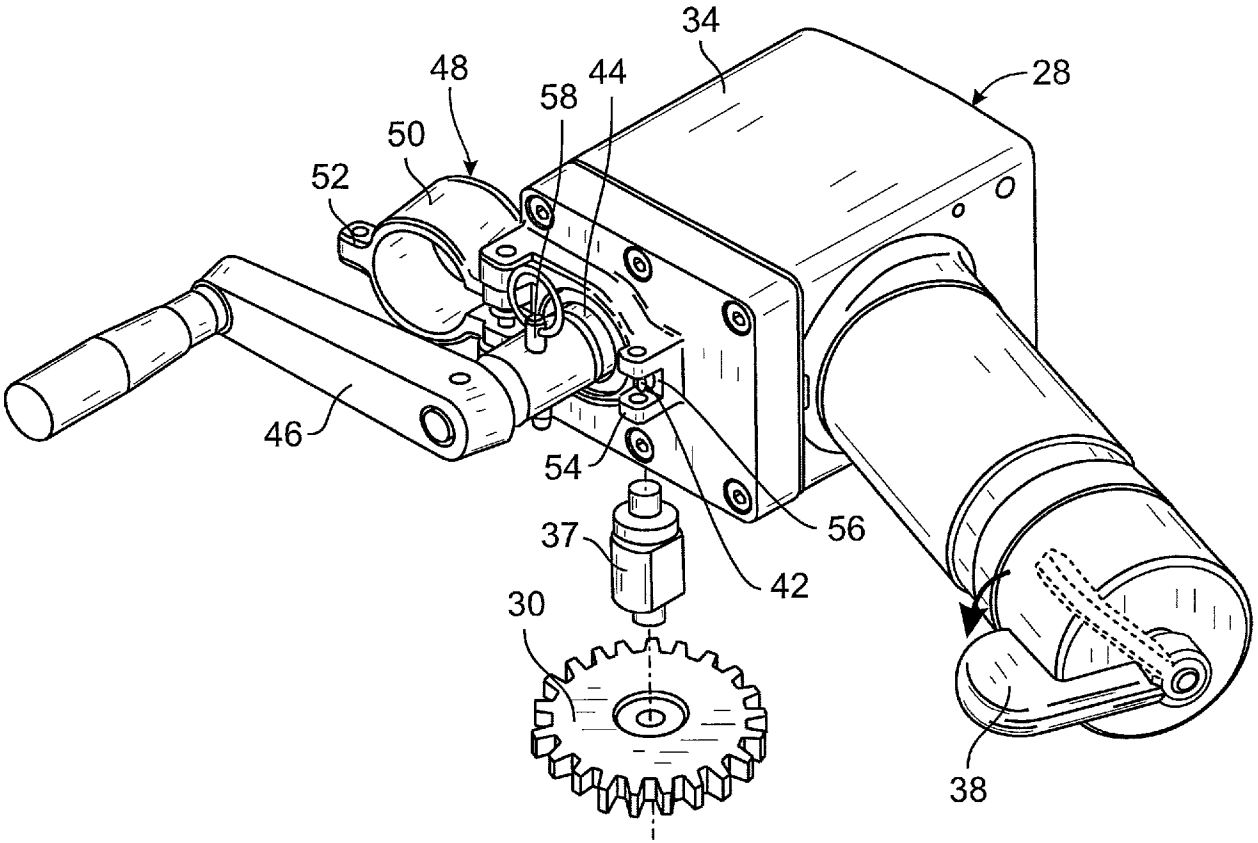
FIG. 3C is the example drive unit of FIG. 3A in an open configuration with a hand-powered crank attached.

Turning to FIGS. 3A-C, the drive unit 28, in this example, will be discussed in more detail. In reference to FIG. 3A, an example drive unit 28 is shown in a closed configuration with drive gear 30 of turret drive system 26. As mentioned above, the drive unit 28, in this example includes engagement lever 38 and spindle cap 48. The spindle cap 48, in this example, includes a cover 50 for the spindle 44 and a tab 52 used to secure the cap to the housing 34 of the drive unit 28. In the example shown, a clevis 54 is attached to the housing 34 of the drive unit, and the tab 52 of the spindle cap 48 fits within the recess 56 of the clevis. A clevis pin 58 passes through the clevis 54 and the tab 52 to secure the spindle cap 48 in a closed position. As discussed below in more detail, the tab 52 of the spindle cap 48 actuates a switch 42 that is also positioned within the recess 56 of the clevis 54 when the spindle cap is in a closed position.

The engagement lever 38, in the example shown, is coupled to the housing 34 and brake system 40 (FIGS. 4A-E) of the drive unit 28. The engagement lever 38 may be mechanically coupled to a brake 60 (FIGS. 4A-E) of the brake system 40. The engagement lever 38 may also actuate a switch 43 (FIGS.

4A-E) when the engagement lever is toggled between an engaged and a disengaged position. Movement of the engagement lever 38 to an engaged or disengaged position respectively engages and disengages the brake 60 and the motor shaft (not shown) of the motor 36 of the drive unit 28. The brake system 40 may be, for example, a friction-based braking system. In this example, the brake 60 may stop or secure the motor 36 of the drive unit 28 via friction.

In an alternative configuration, both the brake 60 and the motor shaft may, for example, be keyed such that the keyed motor shaft may fit into a keyed hole (not shown) of the brake 46. In this alternative configuration, engaging the lever 38 engages the keyed motor shaft to the keyed hole of the brake. When the brake 60 engages the motor shaft of the motor 36, in this example, the motor cannot freely spin. Disengaging the lever 38 disengages the keyed motor shaft from the brake 60 allowing the motor 28 to spin freely. In FIG. 3A, the engagement lever 38 is shown in an engaged (or "up") position.

As discussed below with reference to FIGS. 4A-E, the engagement lever 38 may also be electrically coupled to a circuit 64 at the drive unit 28. The controller 20 may monitor the status of the circuit 64 and disable controlled operation of the turret 14 in response to a determination that the circuit is open. As described by way of example below, disengaging the engagement lever 38 may open the switch 43 and thus open the circuit 64. The controller 20 may detect the open circuit and disable controlled operation of the turret 14 in response.

Turning now to FIG. 3B, the example drive unit 28 is shown in an open configuration. The clevis pin 58 has been removed from the clevis 54 allowing the spindle cap 48 to pivot away from the housing 34 of the drive unit 28 and expose the spindle 44 of the drive unit. As mentioned above, a switch 42 may be positioned within the recess 56 of the clevis 54. The switch 42 may be, for example, a push-button microswitch that is depressed by the tab 52 of the spindle cap 48 when the spindle cap is in a closed position as shown by way of example in the enhanced portion of FIG. 3B. When the spindle cap 48 is moved to an open position, as in FIG. 3B, the push-button microswitch 42 becomes un-depressed. Like the engagement lever 38 above, the switch 42 may also be electrically coupled to a circuit 64 at the drive unit 28 to provide for safe manual operation of the turret 14. Like the switch 43 for the engagement lever 38, opening the switch 42 for the spindle cap 48 may open the circuit 64 at the drive unit 28. The controller 20 may detect that the circuit 64 is open due to the open switch 42 associated with the spindle cap 48 and disable controlled rotation of the turret 14 in response.

Referring now to FIG. 3C, the example drive unit 28 is shown in an open configuration with a hand-powered crank 46 attached to the spindle 44. FIG. 3C represents an example configuration of the drive unit 28 when manual operation of the turret 14 (FIG. 1) is desired. As seen in FIG. 3C, the spindle cap 48 is in an open position exposing the spindle 44. A hand-powered crank 46 is attached to the spindle 44. The clevis pin 58, in the example shown, passes through both the crank 46 and the spindle 44 to secure the crank to the spindle. Additionally, the engagement lever 38 is shown in a disengaged (or "down") position. As mentioned above, disengaging the lever 38 (or moving the lever to the down position) mechanically releases the brake 60 of the brake system 40 from the motor 36 (FIGS. 4A-E) allowing the motor to spin freely during manual operation of the turret. Thus, with the brake 60 disengaged from the motor 36 and the hand-powered crank 46 attached to the spindle 44, as shown in FIG. 3C, an operator may manually spin the motor by turning the crank thereby rotating the drive gear 30 and thus the turret 14.

As mentioned above, a storage compartment for the hand-crank 46 may also include a switch that is opened when a turret operator removes the hand-crank from its storage compartment. The switch, in this example, may also be coupled to the circuit 64 of the drive unit 28 such that the circuit opens when the switch opens causing the controller 20 to disable controlled operation of the turret 14 in response. It will be understood, however, that additional or alternative actions or events may indicate that a manual mode of operation has been initiated. Additional or alternative switches, for instance, may be selectively employed to open the circuit 64 in response to these actions or events causing the controller to disable controlled operation of the turret 14 in response.

In reference to FIGS. 4A-E, a schematic view of the controlled vehicle turret apparatus 18 is shown. As mentioned above, the controlled vehicle turret apparatus 18, in this example, includes an input device 22 coupled to a controller 20. The controller 20 is coupled to drive unit 28 of turret drive system 26 (FIG. 2) as shown schematically in FIGS. 4A-E. The drive unit 28, in the examples shown, includes motor 36, engagement lever 38, brake system 40, and switch 42. The brake system 40, in the examples shown, includes a brake 60 and a brake coil 62. Switches 42 and 43, in the example shown, are electrically coupled to the brake system 40 in series. In this example, movement of the spindle cap 48 actuates the switch 42, and movement of the engagement lever 38 actuates the switch 43. The electrical coupling of the switches 42, 43 to the brake system 40, in this example, provides a circuit 64 whereby the path of the circuit is complete when switches 42, 43 are closed and whereby the path of the circuit is open when either switch is open. Switch 42, in this example, is closed when the spindle cap 48 is in a closed position and open when the spindle cap is in an open position. Switch 43, in this example, is closed when the engagement lever 38 is engaged and open when the engagement lever is disengaged.

Additionally, the controller 20 is electrically coupled to the drive unit 28 in the example shown. The electrical coupling of the controller 20 to the drive unit 28 allows the controller to monitor the status of the circuit 64 and disable controller operation of the turret 14 when the circuit is opened.

As seen in FIGS. 4A-E, the drive unit 28, in this example, includes motor 36, brake system 40, and circuit 64. In the example shown, a conductor cable 66 couples the drive unit 28 to the controller 20. The conductor cable 66 includes two motor leads 68 that may transmit, for example, a voltage to the motor 36 causing the motor to spin and rotate the turret 14 (FIG. 1). The conductor cable 66, in the example shown, also includes two circuit leads 70 that enable the controller 20 to monitor the status of the circuit 64. The conductor cable 66 may be, for example, an electrical cable having a 4-pin circular bayonet-type connector 72.

The brake 60 of the brake system 40 may be, for example, an electromagnetic (EM) brake. The brake system 40 may also include brake coil 62 for moving the brake 60. In the example shown, the brake coil 62 is an EM brake coil 62 that can apply the brake 60 to the motor 36 or remove the brake from the motor. The EM brake coil 62 may be, for example, spring-loaded such that a spring (not shown) pushes the brake 60 onto the motor 36 when the spring is uncompressed and pulls the brake away from the motor when the spring is compressed. The position of the EM brake 60, in the example shown, depends on whether the brake coil 62 is energized or de-energized. Energizing the brake coil 62 compresses the spring such that the brake 60 disengages from the motor 36 thus allowing the motor to spin freely. De-energizing the brake coil 62 causes the spring to become uncompressed and the brake 60 engages the motor 36 thus preventing the motor from spinning and preventing the turret from freely rotating. The controller 20 may energize the EM brake coil 62 during controlled operation of the turret 14 so that the motor 36 may spin in response to control signals received from the controller. When the circuit 64 is opened (e.g., when a manual mode of operation is initiated), the controller may de-energize the brake coil. The brake coil 62, in the example shown, is coupled to the circuit leads 70 of the conductor cable 66. Thus, the controller 20 may energize or de-energize the brake coil 62 via the circuit leads 70. The controller may respectively energize and de-energize the EM brake coil 62 by switching between, for example, 24 volts (24V) and ground. It will be understood that other voltages may be selectively employed. As discussed further below, opening the switch 42 or the switch 43 opens the circuit 64 thereby causing the brake coil 62 to become de-energized, which, in turn, applies the brake 60 to the motor 36.

Figure 4A:
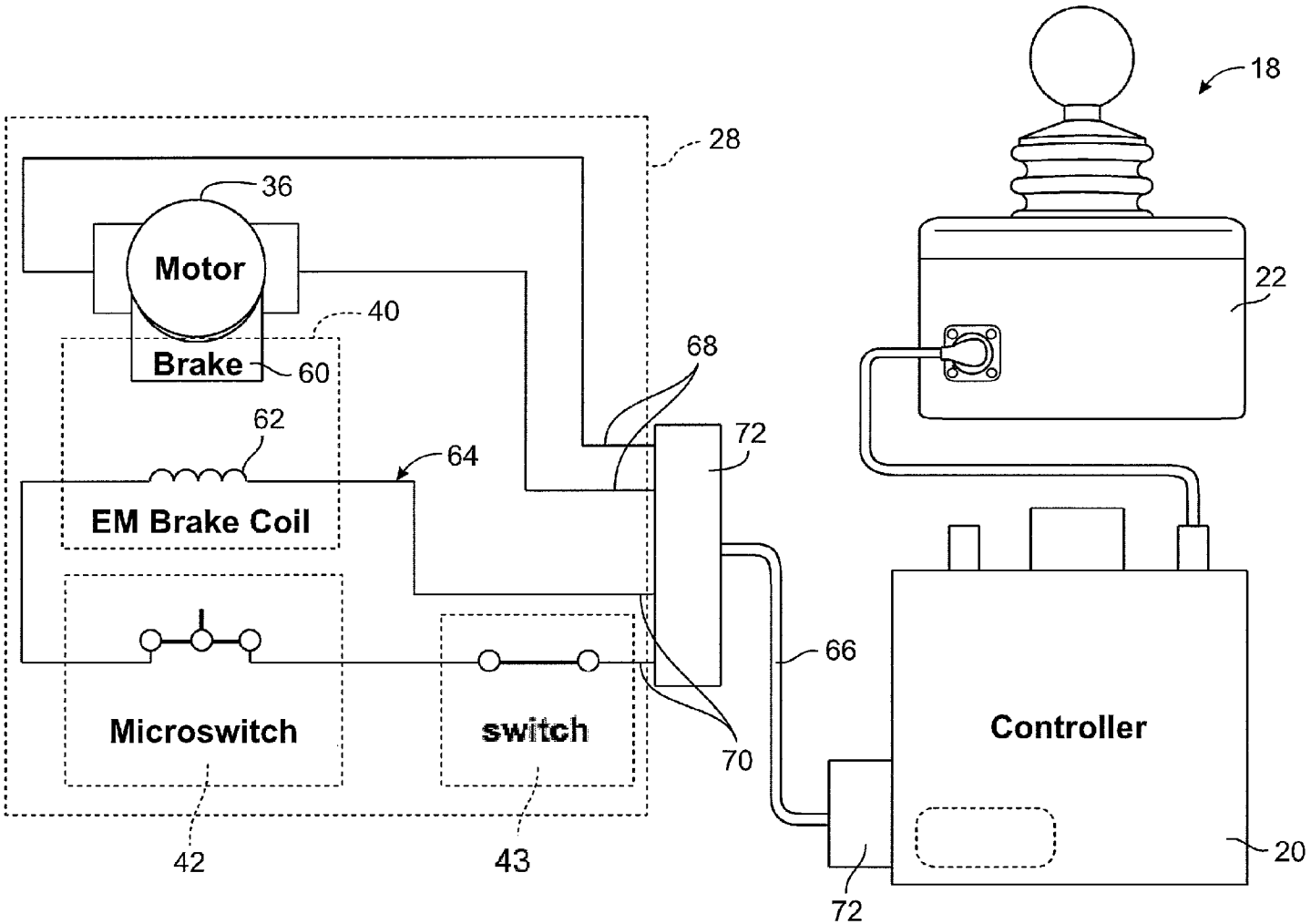
FIG. 4A is a schematic view of a controlled vehicle turret apparatus in a first mode of operation.

Turning to FIG. 4A, a representational schematic of a controlled vehicle turret apparatus 18 is shown in a first mode of operation. The first mode of operation, in the example shown, is a "neutral" mode of operation in which the drive unit 28 of the turret drive system 26 (FIG. 2) is configured to receive input from the input device 22 but is not actually receiving valid input from the input device. The controlled vehicle turret apparatus 18 is configured, in this example, such that the brake 60 engages the motor 36 in the neutral mode of operation as shown in FIG. 4A.

As seen in FIG. 4A, the controller 20 is not receiving valid input from the input device 22. However, the controller 20 and drive unit 28 are poised to drive rotation of the turret 14 once valid input from the input device 22 is received as a result of the complete circuit 64 path for the brake system 40: the engagement lever 38 of the drive unit 28 is engaged and the spindle cap 48 is closed resulting in a closed switch 42. In the neutral mode of operation, the brake coil 62 is not energized. As a result of the de-energized brake coil 62, the brake 60 engages the motor 36 preventing the motor from spinning freely.

Figure 4B:
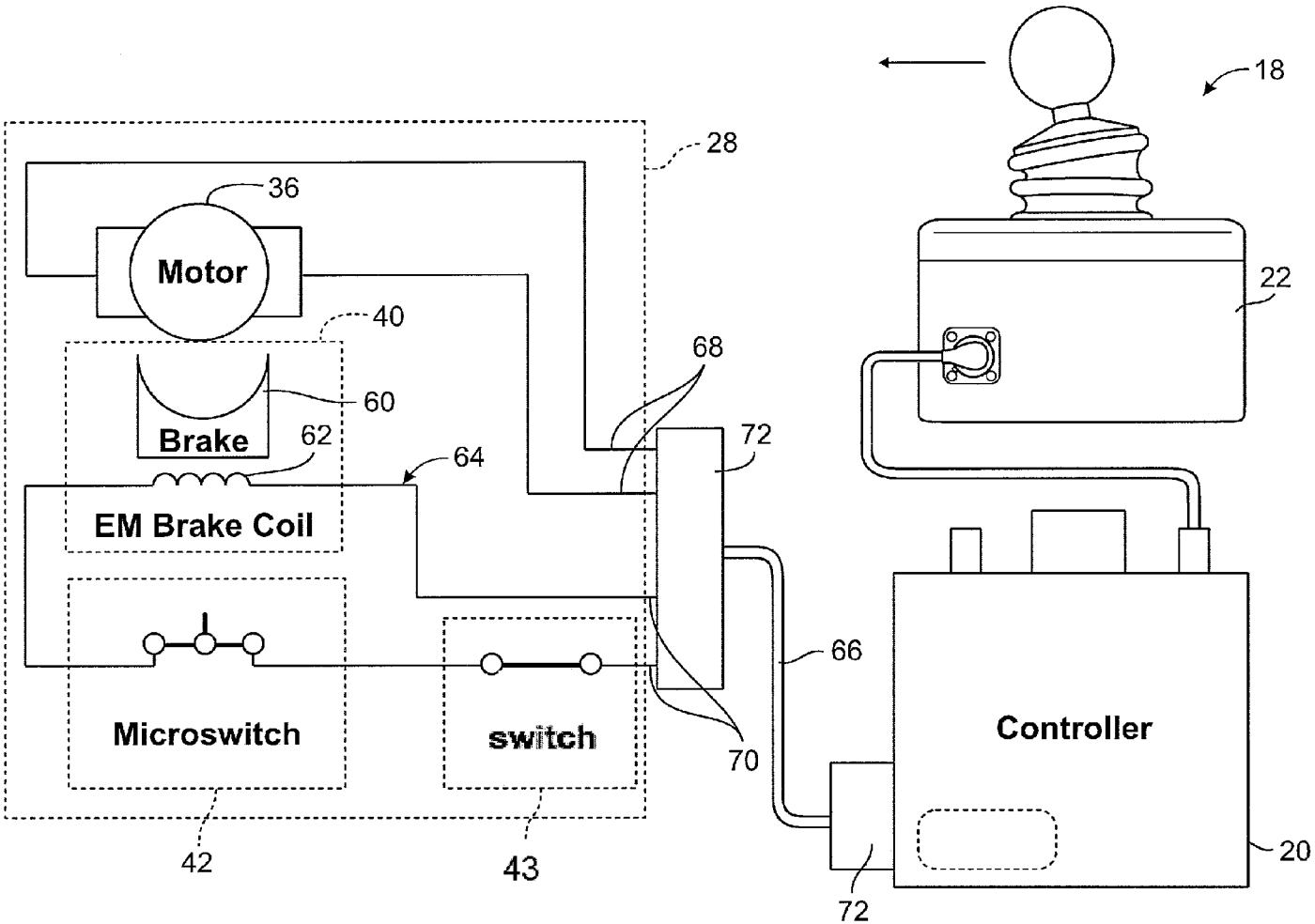
FIG. 4B is a schematic view of a controlled vehicle turret apparatus in a second mode of operation.

In FIG. 4B, the representational schematic of the controlled vehicle turret apparatus 18 is shown in a second mode of operation. In particular, FIG. 4B illustrates a controlled mode of operation in which the input device 22 transmits valid input to the controller 20 as shown by way of example in FIG. 4B. During the controlled mode of operation, the circuit 64 path for the brake system 40 is complete (the engagement lever 38 is engaged and the spindle cap 48 is closed resulting in a closed switch 43 and a closed switch 42 respectively) thus allowing the controller 20 to energize the brake coil 62.

During a controlled mode of operation, the controller 20 energizes the brake coil 62 upon receipt of a valid input signal from the input device 22. Energizing the brake coil 62 releases the brake 60 from the motor 36 allowing the motor to spin in response to receipt of control signals received from the controller 20. The controller 20 then sends control signals (e.g., applies a voltage to the motor leads 68) in response to the input signals received from the input device 22. Thus, the motor 36 drives rotation of the turret 14 in accordance with and in response to the control signals received from the controller 20. When the input device 22 ceases to transmit a valid input signal, the controlled vehicle turret apparatus 18 returns to a neutral mode of operation: the controller 20 stops transmitting control signals to the motor 36 and the controller de-energizes the brake coil 62, which causes the brake 60 to re-engage the motor 36 and prevent the motor from spinning freely.

Also during the controlled mode of operation, the controller 20, in the example shown, monitors the circuit 64 for the brake coil 62. If the controller 20 determines that the circuit 64 path has opened (e.g., as a result of an open switch 42 or an open switch 43) then the controller disables controlled operation of the turret 14 and flashes an error code 74 indicating that the circuit path for the brake system 40 is open (i.e., an open spindle cap 48 or a disengaged lever 38).

Figure 4C:
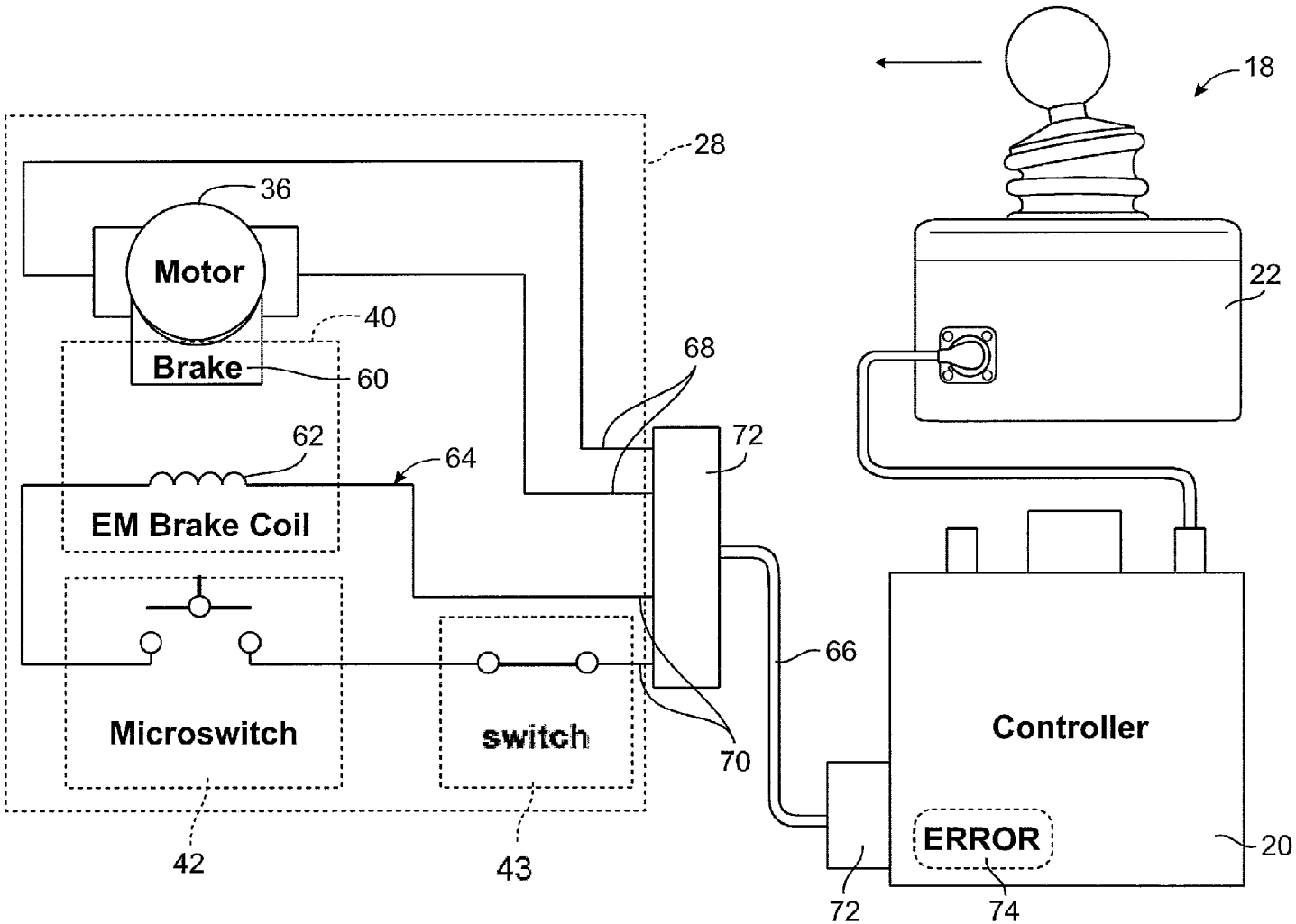
FIG. 4C is a schematic view of a controlled vehicle turret apparatus in a third mode of operation.
Figure 4D:
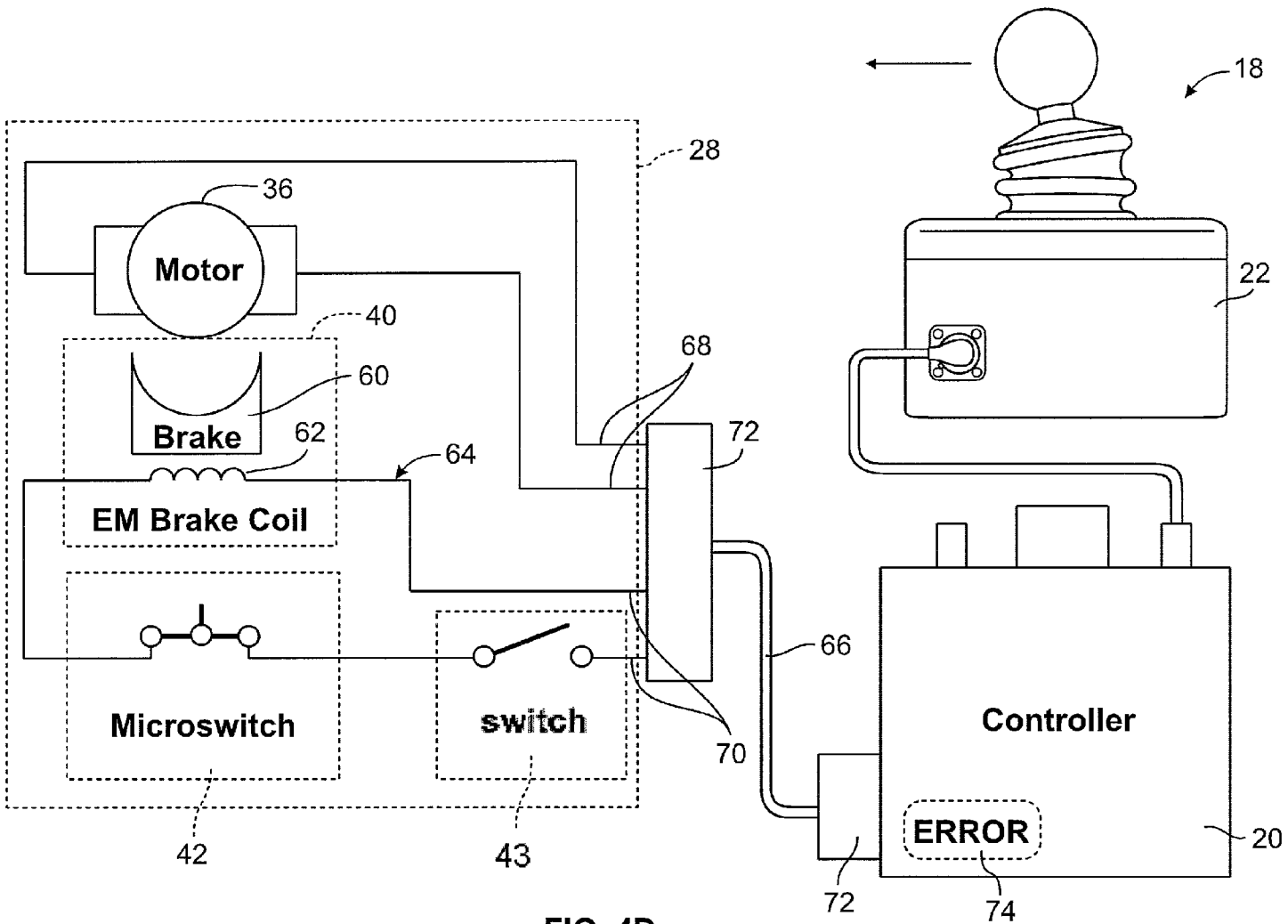
FIG. 4D is a schematic view of a controlled vehicle turret apparatus in a fourth mode of operation.

Referring now to FIG. 4C and FIG. 4D, the representational schematic of the controlled vehicle turret apparatus 18 is shown in a third and fourth mode of operation respectively. The third and fourth modes of operation may be referred to as "fail-safe" modes of operation. The fail-safe modes of operation prevent the motor 36 from spinning when either the spindle cap 48 is open or the engagement lever 38 is disengaged as mentioned above in reference to FIG. 4B. In this way, the controller 20 can disable controlled operation of the turret 14 and prevent the turret 14 from rotating freely if the manual mode of operation is unintentionally initiated—for example, if the spindle cap 48 is opened unintentionally or the engagement lever 38 is disengaged unintentionally.

In reference to FIG. 4C, the representational schematic of the controlled vehicle turret apparatus 18 is shown in a fail-safe mode of operation where the spindle cap 48 is in an open position (open switch 42) and the engagement lever 38 is in an engaged position (closed switch 42). Additionally, the input device 22 may be transmitting valid input to the controller 20. However, the fail-safe elements of the turret drive system 26—i.e., the engagement lever 38 and corresponding switch 43 and the spindle cap 48 and corresponding switch 42—prevent the generation of control signals that spin the motor 36. As a result of the open position of the spindle cap 48, the switch 42 is not actuated and the circuit 64 path for the brake system 40 is open. Due to the open circuit 64 path, the brake coil 62 is de-energized and the brake 60 engages the motor 36 thereby preventing the motor from spinning (as well as the drive shaft 37 of the drive unit 28 and the drive gear 30). Further, the controller 20 detects that the circuit 64 path for the brake system 40 is open and disables controlled operation of the turret. As mentioned above, the controller 20 ignores input signals received from the input device 22 and does not generate control signals corresponding to input signals received.

In addition, the controller 20, in the example shown, may display an error message 74 to the turret operator. The error message 74 may be, for example, an error code that indicates the circuit 64 path for the brake system 40 is open and the brake 60 is engaging the motor 36 preventing the motor from spinning. The turret operator may then take steps to return the controlled vehicle turret apparatus 18 to an operable drive mode. First, the turret operator may close the spindle cap 48 thus actuating the switch 42 and closing the circuit 64 path for the brake system 40. Then, the operator may ensure that the engagement lever 38 is in an engaged position. Once the spindle cap 48 cover has been closed and the engagement lever 38 is in an engaged position, the turret operator may then reset the controller 20, which returns the controller to an operable drive mode.

Referring now to FIG. 4D, the representational schematic of the controlled vehicle turret apparatus 18 is shown in a fail-safe mode of operation where the engagement lever 38 is disengaged (open switch 43) and the spindle cap 48 is in a closed position (closed switch 42). Again, the input device 22 may be transmitting valid input to the controller 20. However, due to the disengaged engagement lever 38 and the open switch 43, the controller 20 detects the open circuit 64 and does not generate control signals corresponding to input signals received from the input device 22. As noted above, disengaging the engagement lever 38 mechanically releases the brake 60 from the motor 36 and opens the circuit 64 path for the brake system 40 by opening the switch 43 in the circuit. The controller 20 is electrically coupled to the drive unit 28, allowing the controller to monitor the status of the circuit 64. When the engagement lever 38 is disengaged as shown in FIG. 4D, the switch 43 opens, which opens the circuit 64. The controller 20 detects the open circuit 64 and disables controlled operation of the turret 14 as a result.

Figure 4E:
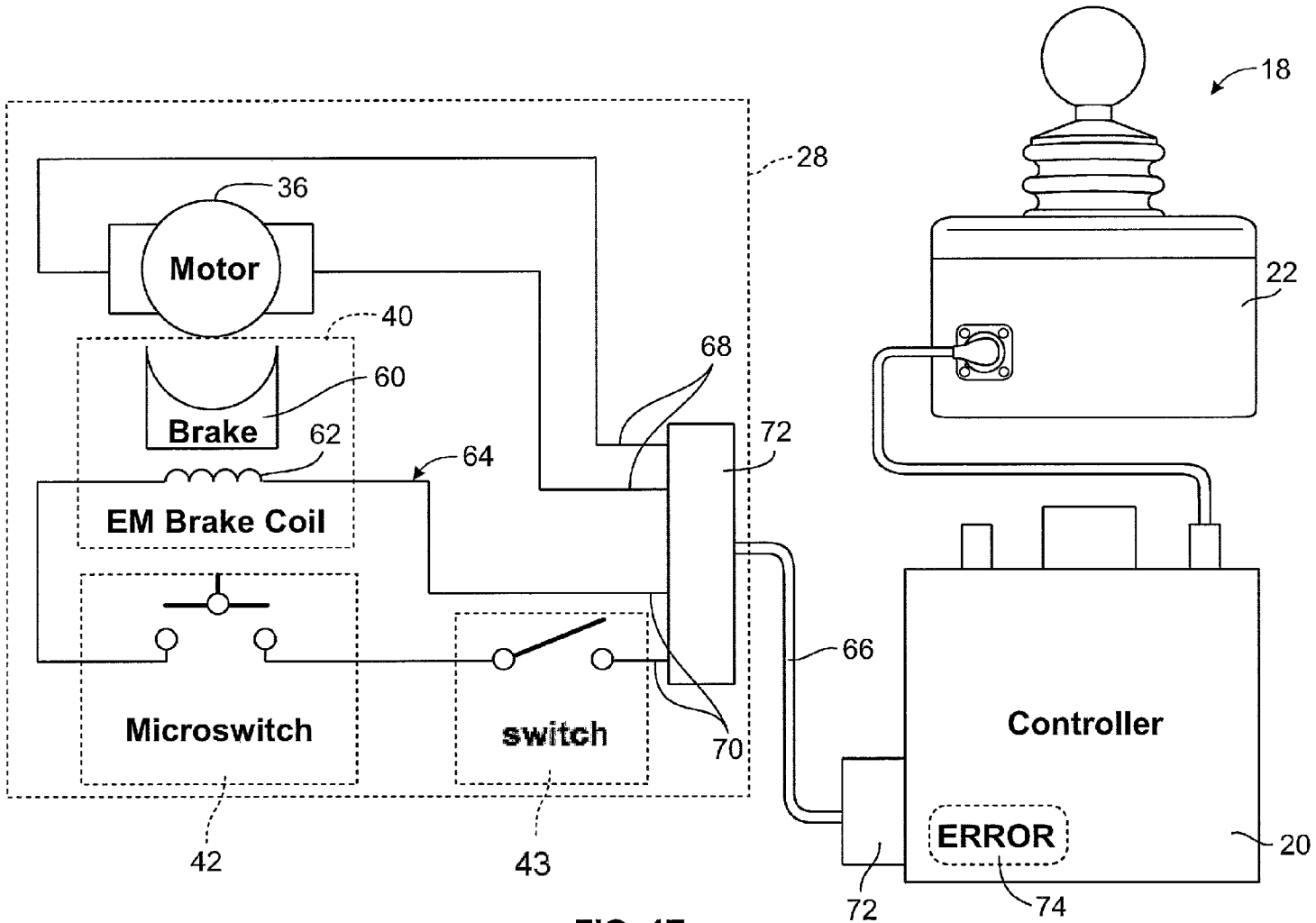
FIG. 4E is a schematic view of a controlled vehicle turret apparatus in a fifth mode of operation.

Turning now to FIG. 4E, the representational schematic of the controlled vehicle turret apparatus 18 is shown in a fifth mode of operation. In particular, the fifth mode of operation may be a manual mode of operation whereby rotation of the turret 14 is controlled via the hand-powered crank 46 as discussed above with reference to FIG. 3C. A turret operator may disengage the engagement lever 38, open the spindle cap 48, and attach the hand-powered crank 46 in order to manually rotate the turret 14. Disengaging the engagement lever 38 mechanically releases the brake 60 from the motor 36 and opens the switch 43. Opening the spindle cap 48 opens the switch 42. The circuit 64 path for the brake system 40 is open as a result of the open switch 42 and the disengaged lever 38. Opening the circuit 64 path for the brake system 40 de-energizes the brake coil 62 as discussed above. In addition to the de-energized brake coil 62, the controller 20 detects the open circuit 64 path and, as a result, disables controlled operation of the turret 14 by ignoring input signals received from the input device 22 and does not generate control signals for the motor 36 of the drive unit 28. The controller 20 detects the open circuit 64 and displays an error 74 like above. Thus, the turret operator may manually rotate the turret 14 via the hand-powered crank 46.

In some circumstances, the controller 20 may limit the manual rotational speed during the manual mode of operation. To limit manual rotation speed, the controller 20 may transmit a braking signal to the motor 36 of the drive unit 28. The braking signal may allow a turret operator to manually spin the motor using the hand-crank 46 up to the desired rotation speed limit. As the turret operator approaches the manual rotation speed limit, the braking signal may make it more and more difficult to rotate the hand-crank to spin the motor. In this way, the controller 20 may use the braking signal to inhibit the spinning of the motor when the turret rotation speed approaches or equals the rotation speed limit. The controller 20, for example, may apply a short across the motor 36 having a duty cycle that is proportional to the desired rotation speed limit.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that a certain of the details described herein can be varied considerably without departing from the basic principles of the invention.

What is claimed is:

1. An apparatus for controlling rotational movement of a turret of a vehicle comprising:

a controller that generates at least one control signal for controlled operation of the turret in a controlled mode of operation;

a hand-actuatable input device configured to provide input signals to the controller in response to operator actuation of the input device, in the controlled mode of operation the controller generates control signals corresponding to input signals received at the controller from the hand-actuatable input device;

a plurality of fail-safe elements in communication with the controller wherein the controller monitors the status of the fail-safe elements to determine if a manual mode of operation has been initiated based on the positioning of one or more of the plurality of fail-safe elements; and wherein the controller disables controlled operation of the turret of the vehicle in response to the controller determining that the manual mode of operation has been initiated based on the positioning of one or more of the fail-safe elements, wherein the controller disables controlled operation of the turret in the manual mode of operation by ignoring input signals received at the controller from the hand-actuatable input device such that control signals corresponding to the input signals are not generated and controlled operation of the turret does not occur.

2. The apparatus of claim 1 wherein, in the controlled mode of operation, the controller transmits the control signals to a drive unit, the drive unit having a motor that provides powered movement of the turret of the vehicle.

3. The apparatus of claim 2 further comprising:

a brake system including a brake that inhibits movement of the motor of the drive unit;

wherein the controller monitors a status of the brake system such that the controller disables controlled operation of the turret of the vehicle in response to a determination that the brake is applied to the motor.

4. The apparatus of claim 3 wherein:

the brake of the brake system is an electromagnetic brake and the brake system further comprises an electromagnetic brake coil;

the brake system releases the brake from the motor when the brake coil is energized and applies the brake to the motor when the brake coil is not energized;

the controller energizes the brake coil during operation of the turret of the vehicle in a controlled mode of operation; and the controller de-energizes the brake coil in response to the determination that the manual mode of operation of the turret has been initiated.

5. The apparatus of claim 4 further comprising a circuit coupled to the controller wherein the controller de-energizes the brake coil when the circuit is opened.

6. The apparatus of claim 5 wherein the circuit further comprises:

a switch, the switch opens the circuit when the switch is opened; and wherein the controller de-energizes the brake coil when the switch is opened such that the circuit is opened.

7. The apparatus of claim 6 wherein at least one of the plurality of fail-safe elements includes a cap that encloses a spindle coupled to the motor of the drive unit for manually spinning the motor in the manual mode of operation, and wherein the switch is actuated in response to movement of the cap.

8. The apparatus of claim 7 wherein:

the switch is opened when the cap is opened to expose the spindle for manually spinning the motor to rotate the turret of the vehicle in the manual mode of operation; and the switch is closed when the cap is closed to cover the spindle.

9. The apparatus of claim 6 wherein at least one of the plurality of fail-safe elements includes a lever mechanically coupled to the brake of the brake system for toggling mechanical engagement of the brake with the motor of the drive unit, the lever opens the switch when the lever disengages the brake from the motor; and wherein the controller de-energizes the brake coil when the lever disengages the brake from the motor such that the switch and the circuit are opened.

10. The apparatus of claim 5 wherein at least one of the plurality of fail-safe elements includes a lever mechanically coupled to the brake of the brake system for toggling mechanical engagement of the brake to the motor of the drive unit, the lever opens the circuit when the lever disengages the brake from the motor; and wherein the controller de-energizes the brake coil when the lever disengages the brake from the motor such that the circuit is opened.

11. The apparatus of claim 5 wherein the controller displays an error message in response to a determination that the circuit is open.

12. The apparatus of claim 4 wherein the controller toggles energization of the brake coil by switching between a voltage source and ground.

13. The apparatus of claim 2 wherein the controller limits a manual rotational speed of the turret during the manual mode of operation by transmitting a braking signal to the drive unit that limits the rotation speed of the motor.

14. A method of controlling rotational movement of a turret of a vehicle comprising:

providing a controller for automatically:

determining that operation of the turret of the vehicle is in a controlled mode of operation;

generating control signals for controlled operation of the turret in response to a determination that operation of the turret is in a controlled mode of operation, the control signals corresponding to input signals received at the controller from a hand-actuatable input device;

monitoring the status of a plurality of fail-safe elements to determine if a manual mode of operation has been initiated based on the positioning of one or more of the plurality of fail-safe elements; and disabling controlled operation of the turret of the vehicle in response to a determination that a manual mode of operation has been initiated based on the positioning of one or more of the fail-safe elements, wherein the controller disables controlled operation of the turret in the manual mode of operation by ignoring input signals received at the controller from the hand-actuatable input device such that control signals corresponding to the input signals are not generated and controlled operation of the turret does not occur.

15. The method of claim 14 wherein, in the controlled mode of operation, the controller transmits the control signals to a drive unit, the drive unit having a motor that provides powered movement of the turret of the vehicle.

16. The method of claim 15 further comprising:

determining that the manual mode of operation has been initiated;

applying a brake of a brake system to the motor of the drive unit to inhibit movement of the motor; and monitoring a status of the brake system such that the controller disables controlled operation of the turret of the vehicle in response to a determination that the brake is applied to the motor.

17. The method of claim 16 wherein the brake of the brake system is an electromagnetic brake and the brake system further comprises an electromagnetic brake coil and further comprising:

releasing the brake from the motor in response to energization of the brake coil;

applying the brake to the motor in response to de-energization of the brake coil;

energizing the brake coil during operation of the turret of the vehicle in a controlled mode of operation; and de-energizing the brake coil in response to the determination that the manual mode of operation of the turret has been initiated.

18. The method of claim 17 further comprising de-energizing the brake coil when a circuit coupled to the controller is opened.

19. The method of claim 18 further comprising:

opening the circuit in response to an opening of a switch coupled to the circuit; and de-energizing the brake coil when the switch is opened such that the circuit is opened.

20. The method of claim 19 wherein at least one of the plurality of fail-safe elements includes a cap covering a spindle coupled to the motor of the drive unit for manually spinning the motor in the manual mode of operation, and further comprising actuating the switch in response to movement of the cap.

21. The method of claim 20 wherein:

the switch is opened when the cap is opened to expose the spindle for manually spinning the motor to rotate the turret of the vehicle in the manual mode of operation; and the switch is closed when the cap is closed to cover the spindle.

22. The method of claim 19 wherein at least one of the fail-safe elements includes a lever mechanically coupled to the brake of the brake system, and further comprising:

providing toggled mechanical engagement of the brake with the motor of the drive unit via the lever mechanically coupled to the brake;

opening the switch in response to a disengagement of the brake from the motor via the lever; and de-energizing the brake coil when the lever disengages the brake from the motor such that the switch and the circuit are opened.

23. The method of claim 18 wherein at least one of the fail-safe elements includes a lever mechanically coupled to the brake of the brake system, and further comprising:

opening the circuit in response to disengagement of the brake from the motor via the lever mechanically coupled to the brake; and de-energizing the brake coil when the lever disengages the brake from the motor such that the circuit is opened.

24. The method of claim 18 further comprising:

determining that the circuit is open; and displaying an error message in response to the determination that the circuit is open.

25. The method of claim 17 further comprising switching between a voltage source and ground to toggle energization of the brake coil.

26. The method of claim 14 further comprising:

determining that the manual mode of operation has been initiated; and limiting a manual rotational speed of the turret by providing a braking signal to the drive unit that limits the rotation speed of the motor.

* * * * *